US005875423A

United States Patent [19]

Matsuoka

[11] Patent Number: 5,875,423

[45] Date of Patent: Feb. 23, 1999

[54] METHOD FOR SELECTING NOISE CODEBOOK VECTORS IN A VARIABLE RATE SPEECH CODER AND DECODER

[75] Inventor: Bunkei Matsuoka, Tokyo, Japan

[73] Assignee: Mitsubishi Denki Kabushiki Kaisha, Tokyo, Japan

[21] Appl. No.: 953,437

[22] Filed: Oct. 17, 1997

[30] Foreign Application Priority Data

Mar. 4, 1997 [JP] Japan ..... 9-049364

[51] Int. Cl.[6] ..... G10L 3/02

[52] U.S. Cl. ..... 704/220; 704/221; 704/223; 704/226

[58] Field of Search ..... 704/220, 221, 704/223, 226

[56] References Cited

U.S. PATENT DOCUMENTS

| | | | |
|---|---|---|---|
| 5,305,332 | 4/1994 | Ozawa | 371/31 |
| 5,408,234 | 4/1995 | Chu | 341/106 |
| 5,450,449 | 9/1995 | Kroon | 375/350 |
| 5,615,298 | 3/1997 | Chen | 395/2.37 |
| 5,654,964 | 8/1997 | Wake | 370/395 |
| 5,659,622 | 8/1997 | Ashley | 381/94 |
| 5,717,724 | 2/1998 | Yamazaki et al. | 375/346 |
| 5,727,122 | 3/1998 | Hosoda et al. | 395/2.32 |
| 5,732,390 | 3/1998 | Katayanagi et al. | 704/227 |

FOREIGN PATENT DOCUMENTS

A7-36495 2/1995 Japan .

OTHER PUBLICATIONS

Fast CELP coding based on algebraic codes, J–P Adoul, et al, Communication Research Center University of Sherbrooke Sherbrooke, P.Q., Canada JIK 2R1, pp. 1957–1960.

Special Fearute: ITU Standard Algorithm for 8–kbits/s Speech Coding, Basic Algorithm of Conjugate–structure Algebric CeLP(CS–ACELP), Speech Coder, Akitoshi Kataoka, et al, pp. 24–29.

NTT R&D vol. 45 4 1996, CS–ACELP, Basic Algorithm of Conjugate–Structure Algebraic CELP (CS–ACELP) Speech Coder, Akitoshi Kataoka et al, pp. 325 (11)–330 (16).

*Primary Examiner*—David R. Hudspeth
*Assistant Examiner*—Michael N. Opsasnick

[57] ABSTRACT

In a variable rate speech coding method for a CELP speech coding system, an adaptive sound source vector and a first noise source vector are selected from a sound source code book and a noise source code book so that a first synthesized speech signal is obtained which has a minimum distortion relative to an input speech signal. A virtual reference speech signal is generated using a sound source signal which is produced using the adaptive sound source vector. A second noise source vector corresponding to the adaptive sound source vector is selected so that a second synthesized speech signal is obtained which has a minimum distortion relative to the virtual reference speech signal. The sending of a noise source code book index corresponding to the first noise source vector is suspended according to the quality of the second synthesized speech signal.

3 Claims, 7 Drawing Sheets

METHOD FOR SELECTING NOISE CODEBOOK VECTORS IN A VARIABLE RATE SPEECH CODER AND DECODER

BACKGROUND OF THE INVENTION

1. Field of the Invention

The present invention relates generally to a radio communication system employing as a line multiplexing system a CDMA (Code Division Multiple Access) system which allows more ease in variable rate transmission than other speech coding systems for transmission and storage of speech information and a radio/wire communication system utilizing an ATM (Asynchronous Transfer Mode) switching system. More particularly, the invention pertains to a variable rate speech coding method and decoding method for storage of speech information, for instance, which are based on a CELP (Code Excited Linear Prediction) speech coding method and control whether or not to send sound source information parameters, thereby making the coding rate variable.

2. Description of the Prior Art

As one of conventional variable rate speech coding methods based on the CELP speech coding method, there is disclosed in Japanese Pat. Laid-Open Gazette No. 36495/95 a method that decides whether or not to transmit a sound source signal for each frame, thereby making its coding rate variable. FIG. 9 shows the coding procedure of each frame according to the conventional variable rate speech coding method. This coding procedure is carried out for each frame of a speech signal. That is, upon completion of the coding of the previous frame, the speech signal of the next frame is input and its coding starts with step SP1. In a linear prediction (hereinafter referred to simply as LP) analysis step SP2, an LP analysis of the speech signal is made to extract the speech signal of the current frame as an LP parameter representing spectrum information. Incidentally, the LP parameter is coded separately to be sent.

In the next sound source code book search step SP3, an adaptive sound source vector and a noise source vector are chosen so that a synthesized speech signal is obtained with a minimum distortion relative to the input speech signal. This is implemented by the use of an A-b-S (Analysis by Synthesis) method which, based on stored previous drive sound source vectors, selects an optimum combination of outputs from an adaptive sound source code book and a noise source code book that will minimize the distortion of the synthesized speech signal relative to the input speech signal of the current frame that is a reference speech signal. The input speech signal is obtained by adding together the adaptive and noise vectors and input into a synthesis filter which is constructed using a quantized version of the LP parameter obtained in step SP2 and from which the above-mentioned synthesized speech signal is output.

The adaptive sound source code book is one that outputs an adaptive sound source vector repeating the sound source signal at intervals of its the pitch period. The noise source code book stores and selectively outputs plural noise source vectors generated, for example, from random noise in a sequential order. Either code book holds therein a normalized version of the gain of the sound source in time sequence. Although the gain is usually computed separately and added to the sound source vector prior to transmission in coded form, the following description will be given on the assumption that each sound source vector contains the sound source gain. With the use of the A-b-S method, the synthesized speech signal is produced at the same time as the optimum combination of the adaptive sound source vector and the noise source vector is obtained.

In the next step SP4, a signal generated using only the adaptive sound source vector selected in SP3 is input into the same synthesis filter as in step SP3 to obtain therefrom a synthesized signal.

In the next step SP5, the synthesized speech signal quality is compared with a threshold value to decide whether or not to send a noise sound source code book index. By this, the variable coding rate is implemented. Step SP5 is composed of an SN ratio computing step SP5*a* of computing the SN ratio of a virtual synthesized speech signal relative to the input speech, a threshold value comparison step SP5*b* of comparing the computed SN ratio with a preset threshold value, a transmission suspending step SP5*c* of suspending the transmission of only the noise source code book index when it is judged in step SP5*b* that speech quality above the threshold value could be obtained even if the noise source code book index is not used, and an ordinary transmission step SP5*d* of transmitting all code book indexes.

Upon completion of the code transmission of the current frame in step SP5, the coding procedure of the frame is finished in step SP6 and the coding process for the next frame is started again with step SP1. In this way, the coding procedure is repeated for all the frames of the speech signal.

Incidentally, in the variable rate speech coding apparatus of the aforementioned Japanese Pat. Laid-Open gazette, even for synthesized speech obtained using the noise source vector alone, the transmission of the adaptive sound source code book index is suspended according to the result of an evaluation with the threshold value similar to the described above. Since the input speech period over which the above processing is performed is limited substantially to a silent duration during which no periodic information is generated, however, the processing does not contribute to improving the speech quality during a voiced steady-state period of speech.

The adaptive sound source code book in the CELP speech coding system has a role representing a periodic structure of speech based on its pitch period, whereas the noise source code book uses a noise component to compensate for a component that cannot fully be represented by the adaptive code book, that is, the remainder of the sound source information except periodic components. With the use of a sound source signal that is generated by adding together such components, it is possible to enhance reproducibility of an encoded sound source signal, permitting the generation of high quality synthesized speech.

With the variable rate speech coding method described above in respect of FIG. 9, only the adaptive. code book index is transmitted but the noise source code book index is normally restrained from transmission during a period with practically no periodicity of speech as in the case of the voiced steady- state period of speech. As referred to above, however, the noise source vector has the function of supplementing the periodic structure that cannot sufficiently be represented solely by the adaptive sound source vector. Without any noise source vector, the representation of the periodic structure would be insufficient, giving rise to a problem that the speech or tone quality in the voiced steady state period of speech is seriously deteriorated as compared with the speech quality when the synthesized speech is created by superimposing both the vectors one on the other.

With the method of the conventional apparatus with no structure for separately transmitting additional information, it is difficult to improve the speech quality in the input speech period during which the noise code book index is not transmitted but only the adaptive code book index is transmitted as mentioned above.

Moreover, the variable rate speech coding method of FIG. 9 computes the SN ratio of the synthesized speech based only on the adaptive sound source vector relative to the input speech signal in the concerned frame and compares the SN ratio with a preset threshold value to determine whether the noise code book index is to be transmitted or not. In the CELP speech coding system, however, coding is usually performed using a distortion minimizing standard for each frame, and consequently, the SN ratio of the synthesized speech signal greatly varies from frame to frame. Hence, with the criterion of judgement using the fixed threshold value, there are both cases where a code book index is transmitted and where it is not transmitted in accordance with the frame, depending on the SN ratio of the synthesized speech signal, for example, even during the steady-state period of speech—this results in the synthesized speech becoming unstable.

SUMMARY OF THE INVENTION

It is therefore an object of the present invention to provide a variable rate speech coding method which is capable of improving the speech quality without impairing the coding efficiency and precludes the possibility of the output synthesized speech becoming unstable even in the input speech period during which only the adaptive code book index is transmitted.

Another object of the present invention is to provide a variable rate speech decoding method for use with the above coding method.

According to a first aspect of the present invention for attaining the above-mentioned objects, there is provided a variable rate speech coding method for the CELP speech coding system which has an adaptive sound source code book for storing an adaptive sound source vector repeating sound source signals of previous frames at intervals of a pitch period and a noise source code book for storing noise source vectors, the method comprising the steps of: selecting and outputting the adaptive sound source vector and a first noise source vector from the adaptive sound source code book and the noise source code book so that a first synthesized speech signal with a minimum distortion relative to an input speech signal is obtained; synthesizing a virtual reference speech signal by using a sound source signal generated from the adaptive sound source vector; selecting a second noise source vector corresponding to the adaptive sound source vector so that a second synthesized speech signal with a minimum distortion relative to the virtual reference signal is obtained; and suspending the sending of a noise source code book index corresponding to the first noise source vector according to the quality of the second synthesized speech signal. With this variable rate speech coding method, even when the noise source code book index is not sent, the decoding side is capable of selecting and using a noise source vector common to that used at the coding side; hence it is possible to implement coding without serious degradation of speech quality.

According to a second aspect of the present invention, the step of suspending the sending of the noise source code book index comprises the steps of: converting the speech quality of each of the first and second synthesized speech signals and the virtual reference speech signal into a numerical representation relative to the input speech signal; calculating a threshold value for comparison through utilization of the speech quality of the first synthesized speech signal and the computed virtual reference speech signal; comparing the second synthesized speech signal with the threshold value; and deciding whether or not to send the noise source code book index corresponding to the first noise source vector according to the result of the comparison. With this configuration, since the threshold value varies with the quality of the synthesized speech signal for each frame, it is possible to more stably decide whether or not to send the code book index than in case of holding the threshold value unchanged as in the prior art.

According to a third aspect of the present invention, there is provided a variable rate speech decoding method for the CELP speech decoding system which has an adaptive sound source code book for storing an adaptive sound source vector repeating sound source signals of previous frames at intervals of a pitch period and a noise source code book for storing noise source vectors, the method comprising the steps of: generating a first synthesized speech signal from a sound source generated using both of an adaptive sound source vector and a noise source vector corresponding to an adaptive sound source code book index and a noise source code book index when they are contained in a received signal sequence; synthesizing a virtual reference speech signal from a sound source generated using the adaptive sound source vector corresponding to the adaptive sound source code book index when the noise source code book index is not contained in the received signal sequence; and selecting a noise source vector corresponding to an adaptive sound source vector indicated by the received adaptive sound source code book index so that a synthesized speech signal with a minimum distortion relative to the virtual reference speech signal is obtained, and outputting a second synthesized speech signal produced based on the result of the selection. With this method, even when the noise source code book index is not received, the decoding side can select and use the noise source vector common to that used at the coding side; hence, it is possible to implement decoding without serious degradation of the speech quality.

BRIEF DESCRIPTION OF THE DRAWINGS

Other objects, features and advantages of the present invention will become more apparent from the following description taken in conjunction with the accompanying drawings, in which.

DETAILED DESCRIPTION OF THE PREFERRED EMBODIMENTS

A detailed description will be given, with reference to the accompanying drawings, of preferred embodiments of the present invention.

[Embodiment 1]

Figure 1:
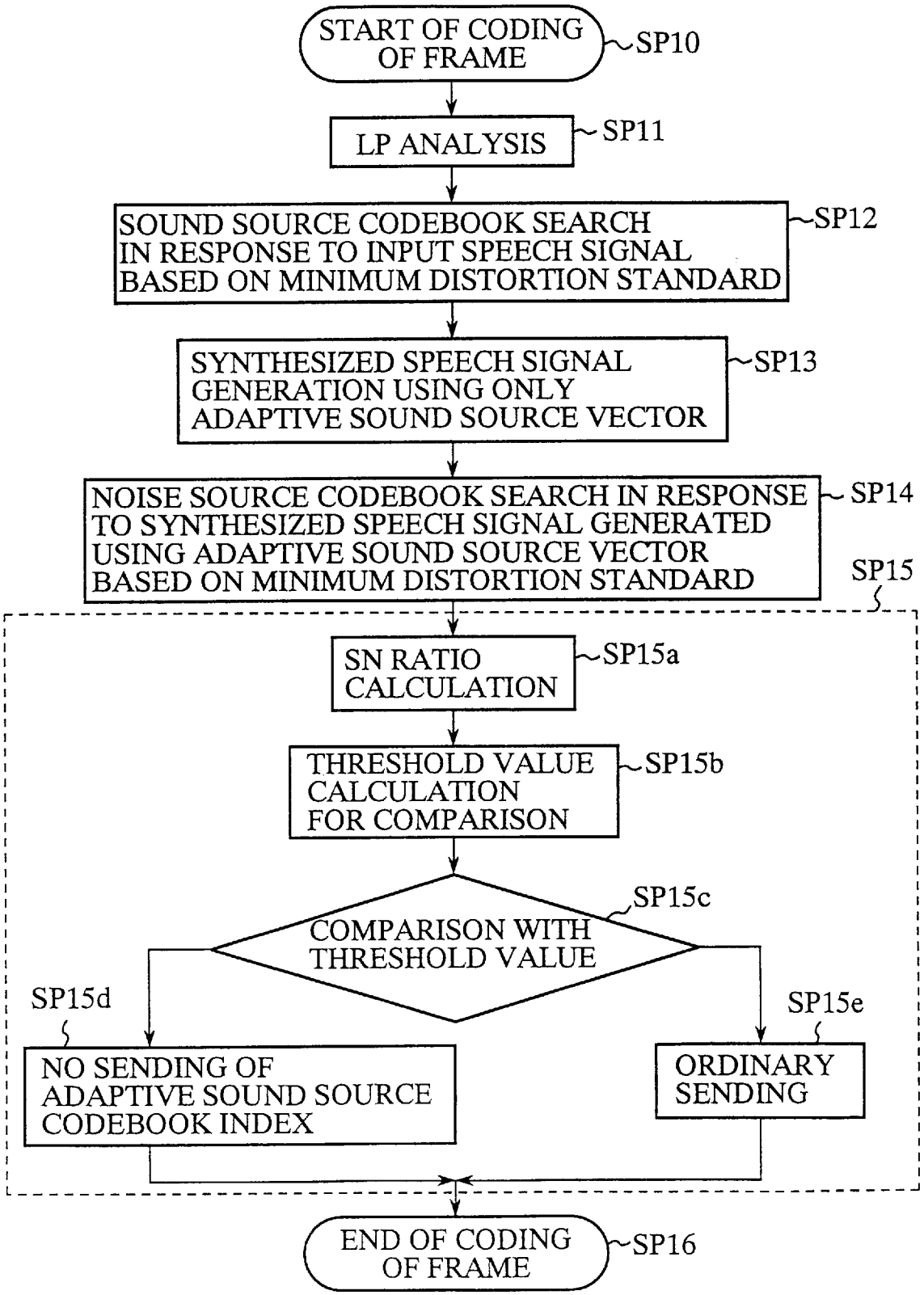
FIG. 1 is a flowchart showing the procedure of a variable rate speech coding method according to a first embodiment of the present invention.
Figure 9:
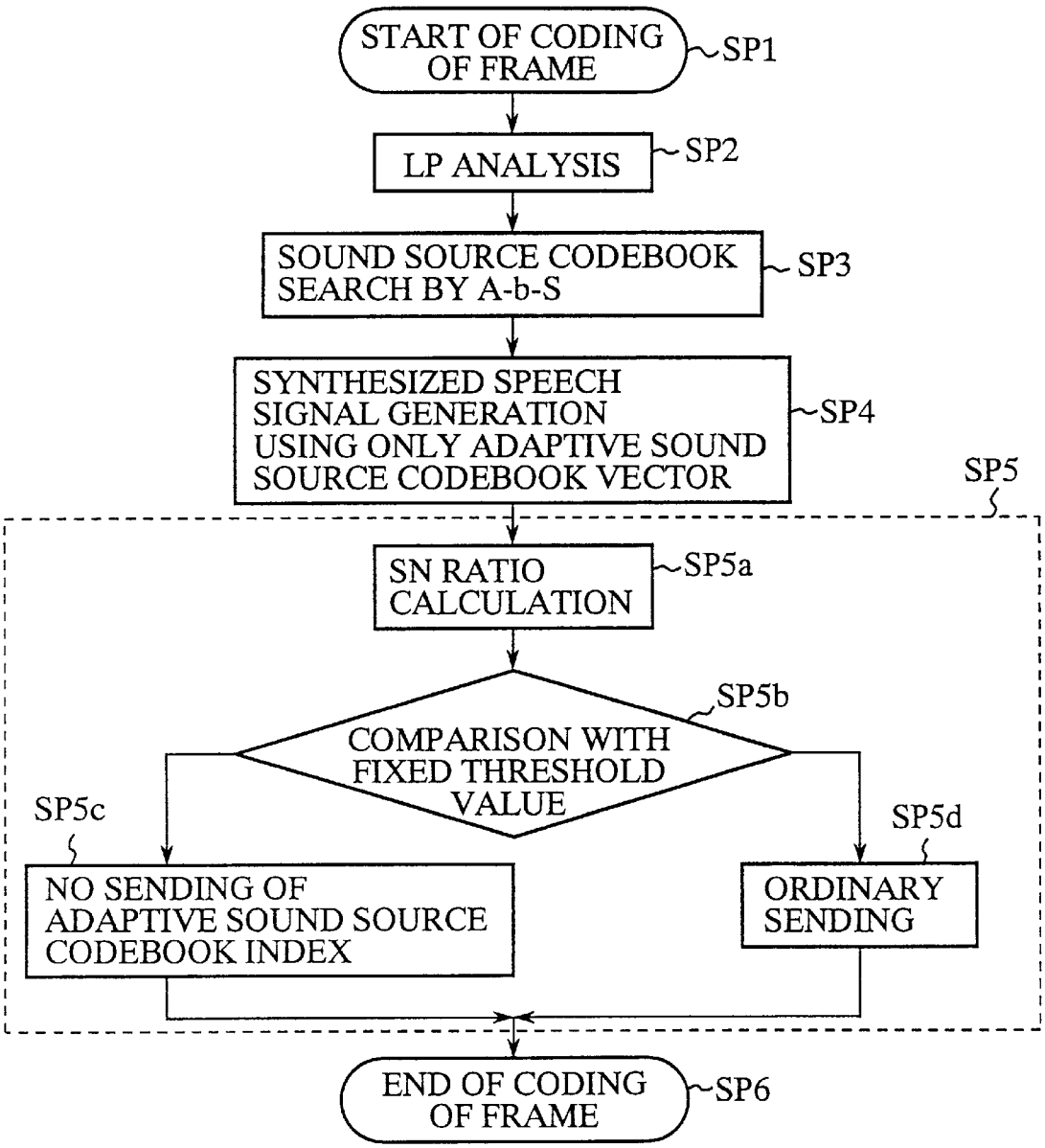
FIG.9(PRIOR ART)
FIG. 9 is a flowchart showing the procedure of a conventional variable rate speech coding method.

FIG. 1 is a flowchart showing the procedure of a first embodiment (Embodiment 1) of the variable rate speech coding method according to the present invention. Embodiment 1 differs from the aforementioned prior art example of FIG. 9 in the inclusion of a second sound source code book search step SP14 and a code word sending line select step SP15. Step SP14 performs processing of selecting a second noise source vector corresponding to the adaptive sound source vector so that a second synthesized speech signal is obtained with a minimum distortion relative to a virtual reference speech signal. Step SP15 performs processing of deciding whether or not to send an index corresponding to a first noise source vector according to the quality of the second synthesized speech signal.

The code word sending line select step SP15 is compose of a synthesized speech quality converting step SP15*a*, a threshold calculating step SP15*b*, a threshold value comparison step SP15*c*, a transmission suspending step SP15*d* and an ordinary transmission step SP15*e*. Incidentally, the LP analysis step SP11, the sound source code book search step SP12 and the virtual reference speech signal synthesize step SP13 are the same as those used in the conventional variable rate speech coding method of FIG. 9, and hence they will be referred to in brief in the following description.

With the variable rate speech coding method, the coding procedure is carried out for each frame of the speech signal. That is, upon completion of the coding of the previous frame, the speech signal of the next frame is input and its coding starts with step SP10, followed by the LP analysis step SP11, the sound source code book search step SP12 and the virtual reference speech signal synthesize step SP13.

These steps are executed in the same manner as in the prior art. In the LP analysis step SP11 an LP parameter is provided. In the next sound source code book search step SP12, an adaptive sound source vector and a noise source vector are selected so that a first synthesized speech signal is obtained with a minimum distortion relative to a reference speech signal as the input speech signal, and the selected vectors are provided together with the first synthesized speech signal. In the virtual reference speech signal synthesize step SP13 a virtual reference speech signal is created.

Thereafter, the second sound source code book search step SP14 is performed. In this step the noise source vector is selected again so that a second synthesized speech signal is obtained with a minimum distortion relative to the above-mentioned virtual synthesized speech signal. That is, a noise source vector, which makes an optimum combination with the adaptive sound source vector obtained in the sound source code book search step SP12, is selected by the aforementioned A-b-S method, as a second noise source vector, so as to minimize the distortion of the second synthesized speech signal relative to the virtual reference speech signal created in the virtual speech signal synthesize step SP13, and the second synthesized speech signal is output.

In Embodiment 1, the first noise source vector obtained in the sound source code book search step SP12 is sent to the decoding side, but the second noise source vector is not sent, and hence it need not be output in the second sound source code book search step SP14.

Next, it is decided in the code word sending line select step SP15 whether or not to send the first noise source vector. This process begins with the synthesized speech signal quality converting step SP15*a*, wherein the speech quality of each of the first and second synthesized speech signals and the virtual speech signal is computed in numerical form by comparison with the input speech signal of the current frame. In this example the SN ratio of each synthesized speech signal with respect to the input speech signal is used as the numerical value.

After the synthesized speech quality converting step SP15*a,* the SN ratio of each synthesized speech signal is used to compute a threshold value for decision in the threshold value computing step 15*b*. In this example, the threshold value is calculated using a prepared algorithm as described below. The algorithm in Embodiment 1 can be implemented using a scheme that formulates statistical properties (mean, variance) of the SN ratios of the first and second synthesized speech signals and the virtual reference speech signal relative to the input speech signal by using data in large quantities.

TABLE 1

| | 1st synthesized speech signal quality | 2nd synthesized speech signal quality | Virtual reference speech signal quality |
|---|---|---|---|
| Mean (dB) | 11.8 | 9.32 | 8.79 |
| Variance (dB) | 7.22 | 7.40 | 7.43 |

This table shows examples of the mean and variance of the SN ratios of the first and second synthesized speech signals and the virtual reference signal relative to the input speech signal for each of about 6,000 frames of five sentences read by each of male and female speakers in experiments conducted with a variable rate speech coding apparatus embodying the method of this embodiment. As is evident from the table, the mean value of the SN ratio of the second synthesized speech signal takes a value that divides internally the mean values of the first synthesized speech signal and the virtual reference signal in a ratio of 8:2 or so and the same goes for the variance.

Since the signals are nearly equal in the variance of the SN ratio, the internal ratio of variance can be used as the reference for computing the threshold value. That is, the SN ratios of the first and second synthesized speech signals and the virtual reference signal relative to the input speech signal are calculated and the value at the point of internally dividing the SN ratios in a certain fixed ratio (8:2 or so in the example shown in Table 1) is calculated as the threshold value.

In the threshold comparison step SP15*c* comparison is made between the threshold value computed as described above and the SN ratio of the second synthesized speech signal. When the SN ratio of the second synthesized speech signal is above the threshold value, the transmission suspending step 15*d* is executed to suspend the transmission of the first noise source vector. When the SN ratio of the second synthesized speech signal is below the threshold value, step SP15*e* is executed to transmit the first noise source vector as usual. As is statistically evident from Table 1, even when the first noise source vector is not sent, the use of the second synthesized speech signal achieves higher speech quality than in the case of using the virtual reference speech signal.

After the code of the current frame is sent in the code word sending line select step SP15, the coding of the frame is finished in the next step SP16 and the coding of the next frame is started again with step SP10. In this way, the coding is repeated for each frame.

Figure 2:
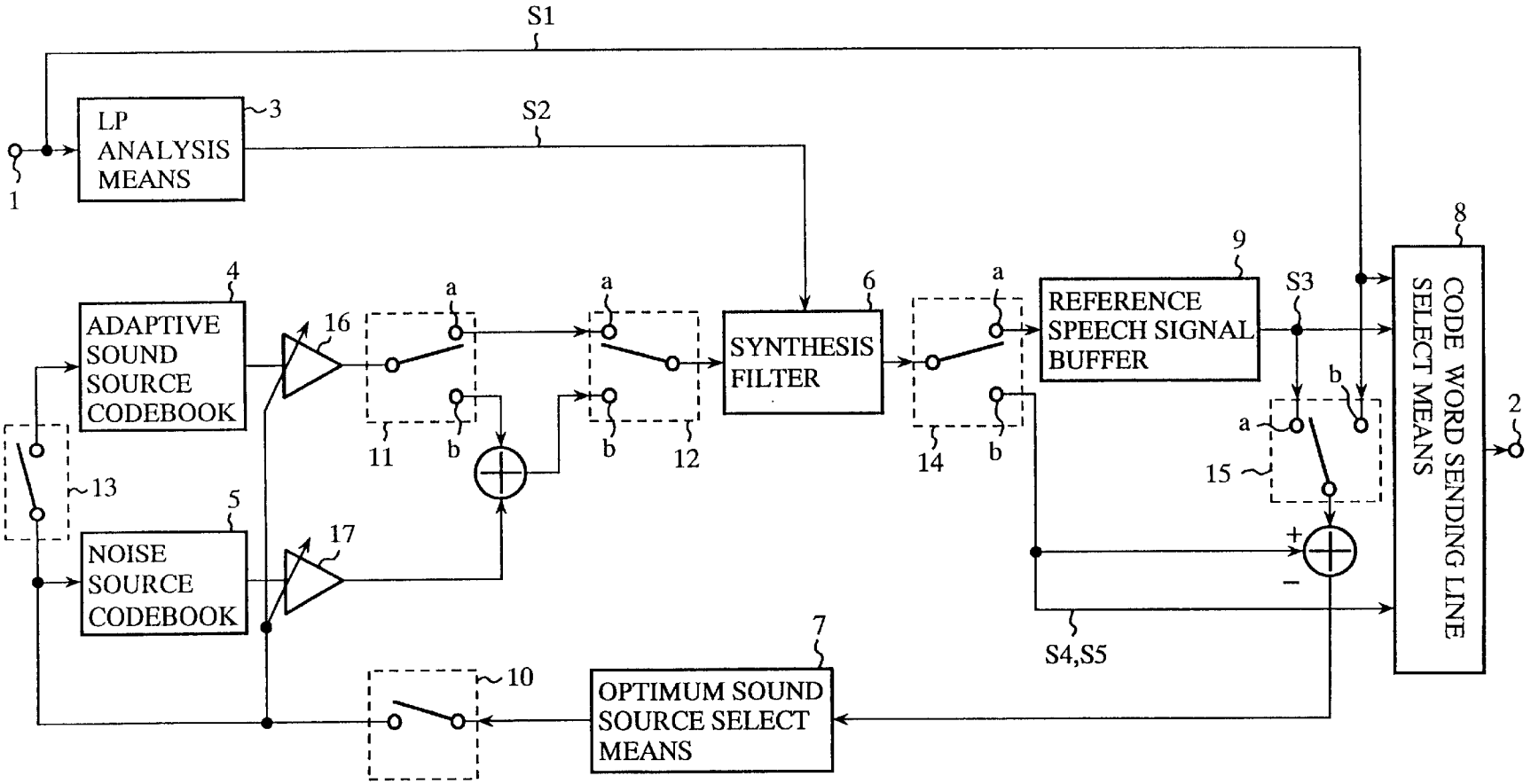
FIG. 2 is a block diagram for explaining the signal flow in variable rate speech coding method of FIG. 1.
Figure 3:
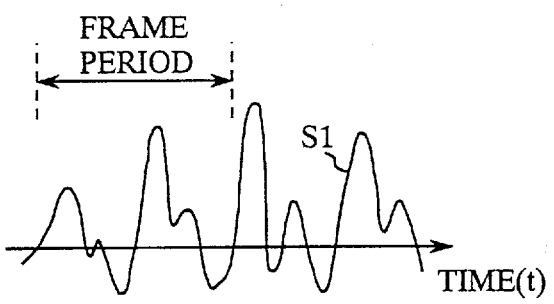
FIG. 3 is a waveform diagram showing an input speech signal.
Figure 4:
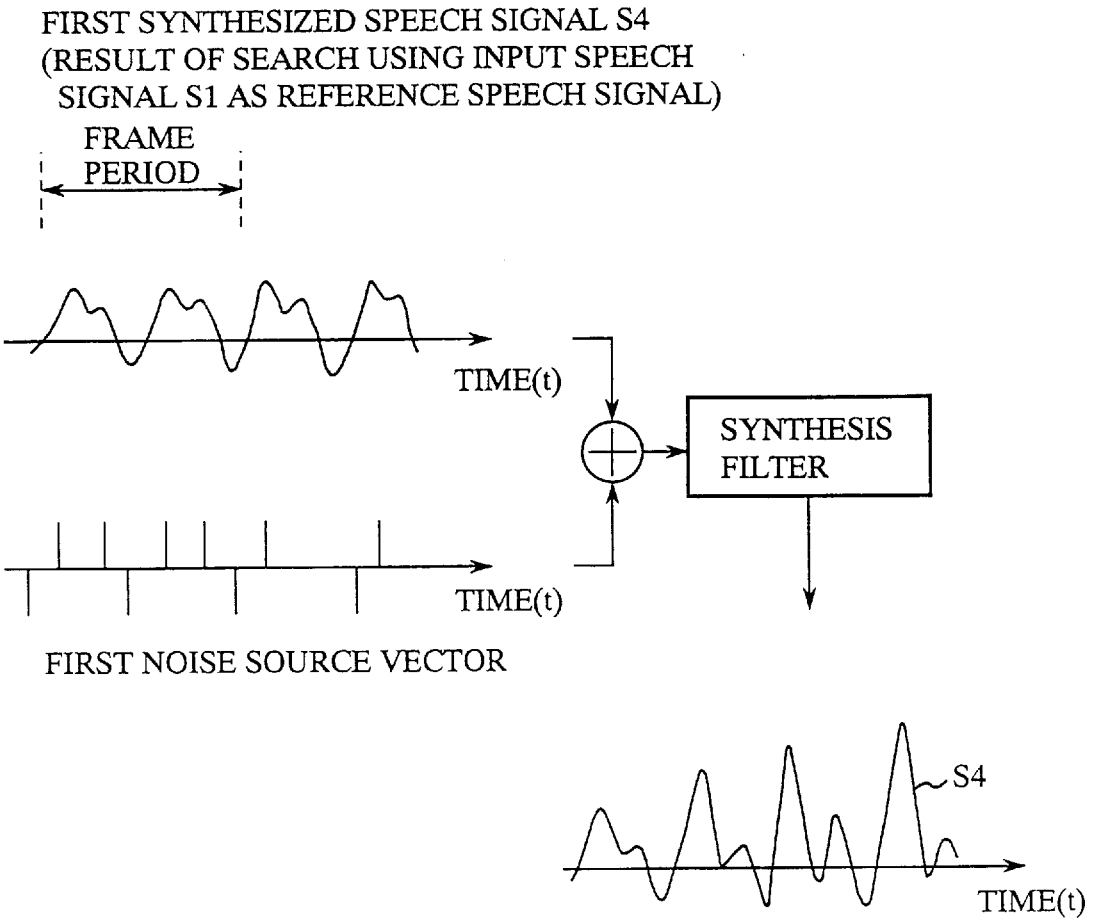
FIG. 4 is a waveform diagram showing a first synthesized speech signal.

Turning next to FIG. 2, concrete operations of the variable rate speech coding method of the first embodiment will be described. In the figure, reference numeral 1 denotes a speech signal input terminal, 2 a code output terminal, 3 LP analysis means, 4 an adaptive sound source code book, 5 a noise source code book, 6 a synthesis filter, 7 optimum sound source select means, 8 code word sending line select means, 9 a virtual reference speech signal buffer, 10, 11, 12 and 13 sound source select switches, 14 a synthesized speech signal output switch, 15 a reference speech signal select switch, 16 adaptive sound source gain select means and 17 a noise source gain select means. Reference character S1 denotes an input speech signal, S2 a LP parameter, S3 a virtual reference speech signal, S4 a first synthesized speech signal, S5 a second synthesized speech signal and S6 a sound source code book selection control signal.

The input speech signal S1 is actually input via the speech signal input terminal 1, and a code sequence selected by the code word sending line select means 8 is output via the code output terminal 2. The input speech signal S1 is applied to the LP analysis means 3, from which the LP parameter S2 is output. The LP parameter S2 is quantized and then sent as part of the code sequence. The adaptive sound source code book 4, the noise source code book 5, the adaptive sound source gain select means 16 and the noise source gain select means 17 are controlled by the sound source code book selection control signal S6 to output an adaptive sound source vector with no gain, a noise source vector with no gain, and adaptive sound source gain and noise source gain, respectively. When the code sequence is once selected, these means 4, 5, 16 and 17 remain in their output state until the start of the next selection. In this specification, the adaptive sound source vector with no gain, the adaptive sound source gain and the noise source vector with no gain, the noise source gain are referred to generically as an adaptive sound source vector and a noise source vector, respectively, and their clusters are identified as an adaptive sound source code book and a noise source code book, respectively.

The synthesis filter 6 is supplied with each sound source signal obtainable from a combination of the LP parameter S2 and the adaptive sound source vector or noise source vector and synthesizes the virtual reference speech signal S3 and the synthesized speech signal S4 or S5. The optimum sound source select means 7 evaluate or assesses distortion of the synthesized speech signals S4 and S5 relative to the reference speech signal S1 or S3 and, at the same time, adjusts and outputs the sound source code book control signal S6 to selectively use the adaptive sound source vector with no gain, the noise source vector with no gain, the adaptive sound source gain and the noise source gain so that the distortion of the synthesized speech signal S4 and S5 is minimized. The code word sending line select means 8 is supplied with the input signal S1, the virtual reference speech signal S3 and the first and second synthesized speech signals S4 and S5 and controls the sending of the noise source code book index according to the speech quality of the signals input thereto and the results of their comparison with a separately computed threshold value. The virtual reference speech signal buffer 9 temporarily stores the virtual reference speech signal for selection of the sound source code book. The sound source select switches 10, 11, 12 and 13 controls the sound source vectors to be selected and their combination. The switch 14 is to select the destination of the synthesized speech signal, depending on whether to generate the virtual reference speech signal S3 or to selectively generate the first and second synthesized speech signals S4 and S5. The reference speech signal select switch 15 selects either one of the input speech signal S1 and the virtual reference speech signal as a reference speech signal that is used for sound source selection. The adaptive sound source gain select means 16 and the noise source gain select means 17 respond to the sound source code book selection control signal S6 to adjust the gains for addition to the respective sound source vectors. The gains thus selected are coded and then sent.

Next, a description will be given, with reference to FIGS. 1 and 2, of the operation for each step. Since the LP analysis step SP11 and the code word sending line select step SP15 in FIG. 1 correspond simply to the LP analysis means 3 and the code word sending line select means in FIG. 2, respectively, no description will be made of them. The sound source code book search step SP12 begins with actuating the sound source select switches 10, 11, 12 and 13, the synthesized speech signal destination select switch 14 and the reference speech signal select switch 15 in FIG. 2 as described below. That is, the switch 10 is closed, the switch 11 is connected to its terminal b, the switch 12 is also connected to its terminal b and the switch 13 is closed. Further, the switch 14 is connected to its terminal b and the switch 15 is also connected to its terminal b.

With the switches connected as mentioned above, the synthesis filter 6 is supplied with a sound source signal that is an added version of the adaptive sound source vector and the noise signal vector and the optimum sound source select means 7 outputs the sound source code book selection control signal S6 to select the adaptive sound source vector and the noise source vector so that the distortion of the synthesized speech signal from the synthesis filter 6 is minimized relative to the input speech signal S1. As the result of the sound source code book search step SP12, the first synthesized speech signal S6 is obtained as the ultimate synthesized speech signal that is output from the synthesis filter 6, and in this case, the adaptive sound source vector and the first noise source vector are being selected which are used as the sound source signal of the synthesized speech signal.

Next, in the virtual reference speech signal synthesizing step SP13 in FIG. 1, the sound source select switch 10 is opened, the switch 11 is changed over to its terminal a, the switch 12 also to its terminal b and the switch 13 is opened. Further, the synthesized speech signal destination select switch 14 is changed over to its terminal a and the reference speech signal select switch 15 to its terminal a. In this instance, the adaptive sound source vector selected in the sound source code book search steps SP12 is input as a sound source signal into the synthesis filter 6, from which it is output as the virtual reference speech signal, which is fed to the virtual reference speech signal buffer 9 and to the code word sending line select means 8.

Next, in the second sound source code book search step SP14 in FIG. 1, the switch 10 is closed, the switch 11 is changed over to the terminal b, the switch 12 also to the terminal b, and the switch 13 is opened. Further, the synthesized speech signal destination select switch 14 is changed over to the terminal b and the reference speech signal select switch 15 to the terminal a. In this instance, the synthesis filter 6 is supplied with a sound source signal that is an added version of the adaptive sound source vector and the noise source vector selected in the sound source code book search step SP12, and the optimum sound source select means 7 outputs the sound source code book selection control signal S6 to select the noise source vector so that the distortion of the synthesized speech signal from the synthesis filter is minimized relative to the virtual reference speech signal S3 held in the virtual reference speech signal buffer 9. As the result of the second sound source code book search step SP14, the second synthesized speech signal S5 is obtained as the ultimate synthesized speech signal that is output from the synthesis filter 6 and the second noise source vector is selected.

While in the above Embodiment 1 has been described on the assumption that the noise source code book is built by appending indexes to time-sequenced vectors obtained by a-priori learning or training or with random noise, the code book may also be constructed by other noise source coding schemes, for example, by the use of so-called algebraic excitation codes disclosed in J-P.Adoul, P.Mabilleau, M.Delprat and S.Morissette, "Fast CELP Coding Based on Algebraic codes," Proc. ICASSP '87, pp. 1957–1960, 1987.

As one of such speech coding systems employing algebraic excitation codes, there is proposed a CS-ACELP (Conjugate- Structure Algebraic) system disclosed in A.Kataoka, S.Hayashi, T.Moriya, A.Kurihara and K.Mano, NTT R&D, Vol. 45, pp. 325–330, 1990 and this system is now in use as an ITU-T G.729 8 kbps standard system. This system may also be used as a basic algorithm of coding for application to the variable rate speech coding method of the first embodiment. The algebraic excitation source in ITU-T G.727 8 kbps standard system is represented by the positions and polarities of four pulses with respect to a subframe of a 5-msec period (40 samples). Where the pitch period is shorter than the subframe length, it is made to repeat at intervals of the pitch period. Moreover, a conjugate-structure gain quantization scheme is employed to provide increased robustness to errors.

Referring now to FIGS. 3 through 6, the effect of the use of the second synthesized speech signal will be described based on waveform observations in the case of using ITU-T G.729 system as the basic algorithm and algebraic excitation codes as the noise source. In FIGS. 3 through 6 the signals corresponding to those in FIG. 2 are identified by the same reference characters. In the course of deriving the first synthesized speech signal S4 of FIG. 4 from the input speech signal S1 of FIG. 3, the first noise source vector takes the form of a pulse train that represents a fine sound source structure of the input speech signal S1 as well as a component that cannot fully be represented by the periodicity of the adaptive sound source vector. It will be understood that the first synthesized speech signal sufficiently follows the fine structure that the input speech signal S1 also has.

Figure 5:
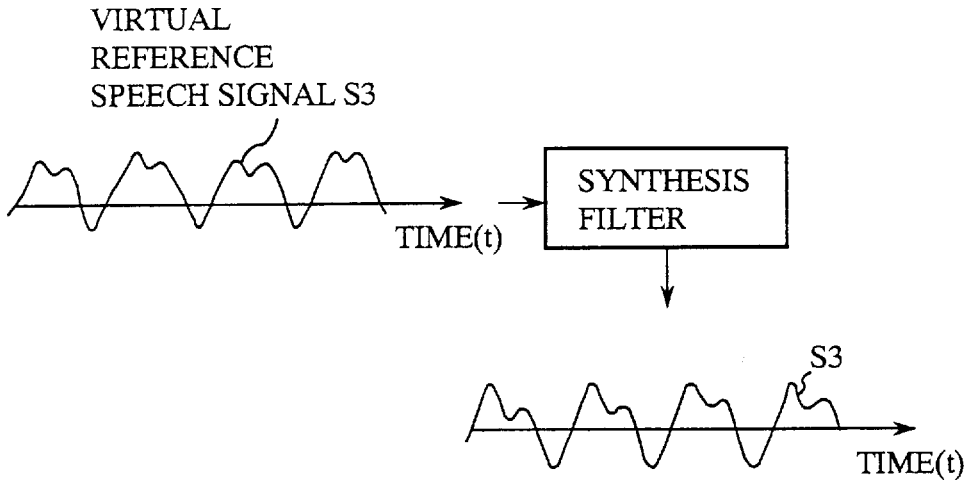
FIG. 5 is a waveform diagram showing a virtual reference speech signal.

In the case of synthesizing the virtual reference speech signal S3 through the use of only the adaptive sound source vector selected in the course of generating the first synthesized speech signal as shown in FIG. 5, the signal S3 takes a simple waveform that substantially repeats with a fixed period and a fixed amplitude throughout the frame; hence, the signal S3 cannot make up for the insufficient representation of the periodic structure appearing in the input speech signal S1. During suspension of the transmission of the noise source code book index in the conventional variable rate speech coding method, the virtual reference speech signal S3 is used intact as the synthesized speech signal output, so that the speech quality is seriously deteriorated.

Figure 6:
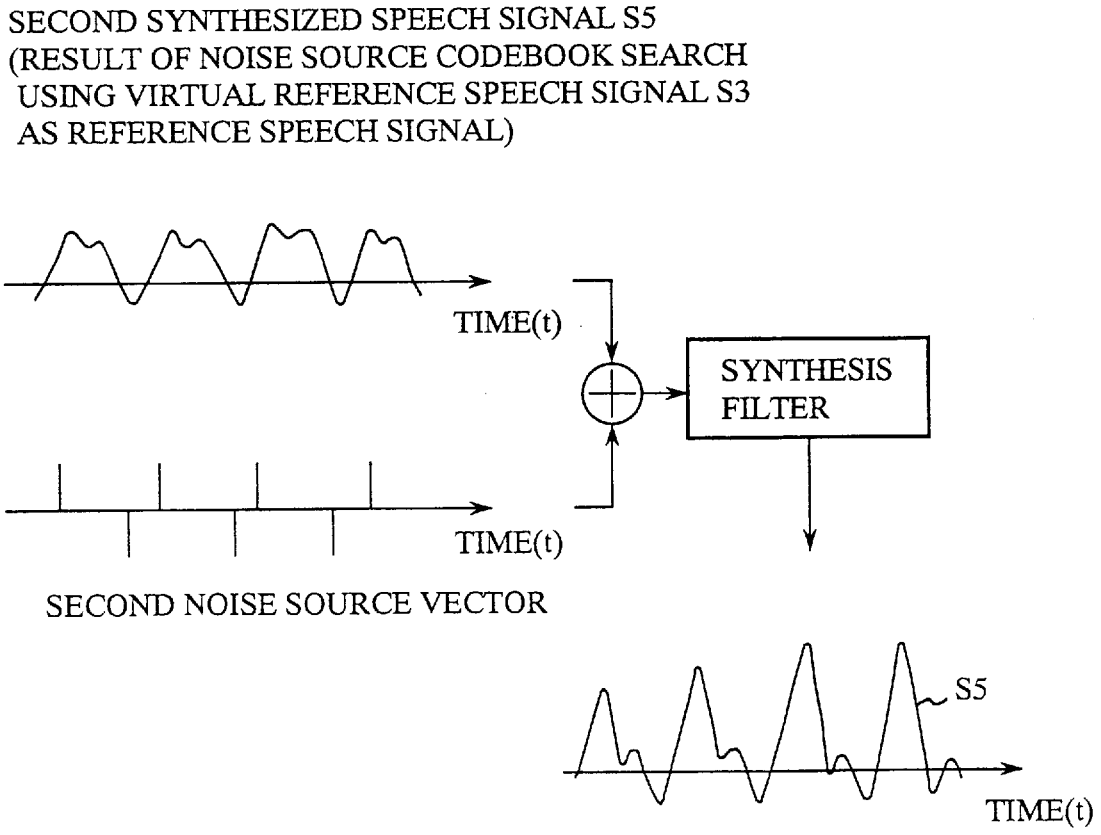
FIG. 6 is a waveform showing a second synthesized speech signal.

On the other hand, as shown in FIG. 6, in the case of the second synthesized speech signal S5, the second noise source vector serves to compensate for the insufficient periodicity representation of the adaptive sound source vector. It will be seen that the second synthesized speech signal sharply improves the periodicity representation as compared with the virtual reference speech signal S3 although it falls short of fully representing the fine structure. In this case, the polarity of each pulse of the second noise source vector an be made the same as the polarity of the virtual reference speech signal S3 at the corresponding position in the subframe. Hence, even when the algebraic excitation codes are used as the noise source, the decoding side can obtain the second noise source vector identical with that used at the coding side without any information about the pulse position and polarity.

In this example employing the CS-ACELP system, the transmission of only the position and polarity of the algebraic excitation code is suspended and during the period of suspending the transmission of the first noise source vector, the second noise source gain is transmitted after being subjected to conjugate structure gain quantization as usual. The suspension of transmission of the first noise source vector is decided for each frame. This permits reduction of 17 or 34 bits from 70 bits per frame during the period of suspending the transmission of the first noise source vector in this example.

According to Embodiment 1 described above, the second noise source vector, which makes up for the periodic structure of the sound source that cannot fully be represented by the adaptive sound source vector alone, can be utilized so that distortion of the synthesized speech signal is minimized relative to the virtual reference speech signal. Hence, it is possible to implement a variable rate speech coding method that prevents the synthesized speech quality from serious degradation even while the first noise source code book index is not transmitted.

[Embodiment 2]

Figure 7:
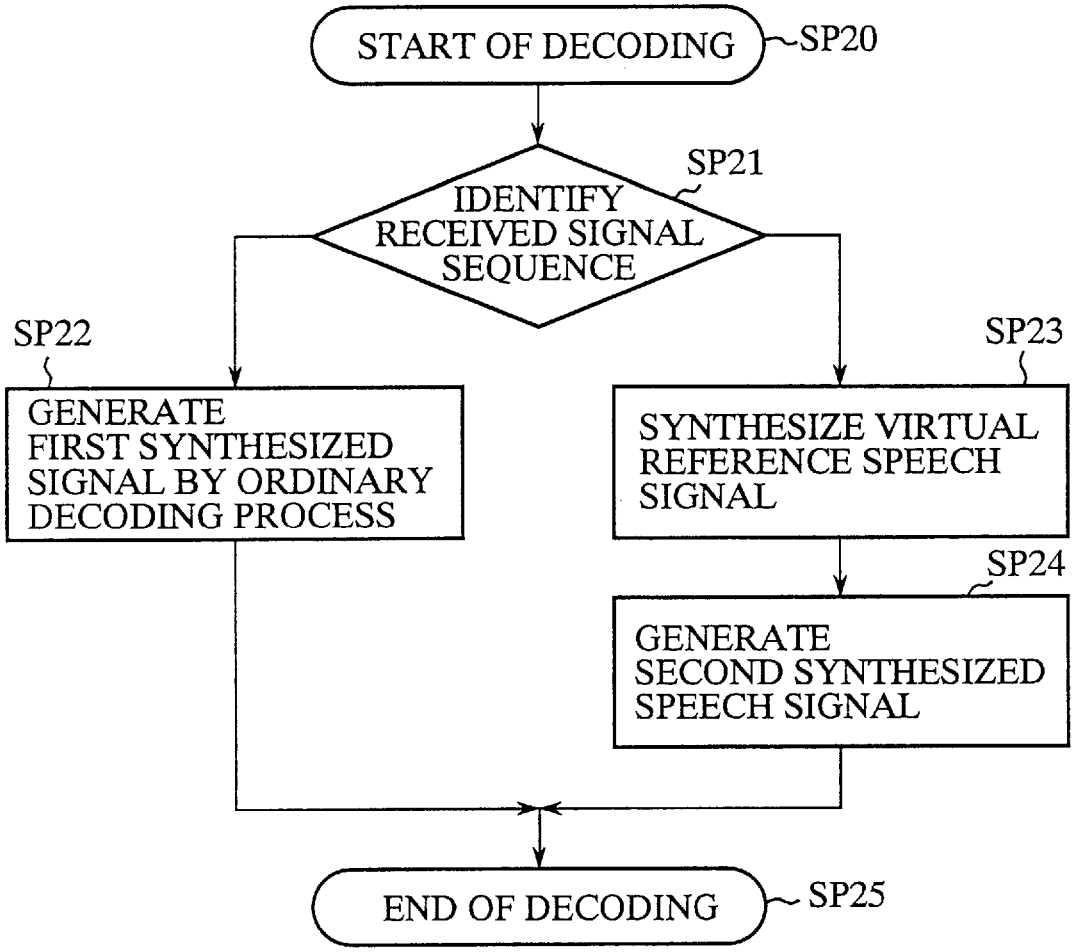
FIG. 7 is a flowchart illustrating the procedure of a variable rate speech decoding method according to a second embodiment of the present invention.

FIG. 7 is a flowchart illustrating the variable rate speech decoding method according to a second embodiment of the present invention (Embodiment 2), which comprises a received signal sequence identifying step SP21, a first synthesized speech signal output step SP21 of outputting a first synthesized speech signal, a virtual reference speech signal synthesizing step SP23 of synthesizing a virtual reference speech signal, and a second synthesized speech signal output step SP24 of outputting a second synthesized speech signal.

In the variable rate speech decoding method of this embodiment, the virtual reference speech signal synthesizing step SP13 is identical with step SP13 described previously in respect of the first embodiment, and hence a description of its operation will be brief. In this speech decoding method the same decoding procedure is repeated for each frame of the received code word sequence. Upon completion of the decoding of the previous frame, the received code word sequence corresponding to the next frame is input and its decoding begins with the step SP20.

In the received signal sequence identifying step SP21, a check is made to see if a noise source code book index is contained in the received signal sequence based on its length. When it is decided in this step SP21 that the noise source code book index is contained in the received signal sequence, a synthesized speech signal is output in the first synthesized speech signal output step SP22. In this step SP22 a sound source signal, which is generated from both of adaptive sound source and noise source vectors corresponding to the received sound source and noise source code book indexes, is input into a synthesis filter constructed using an LP parameter sent as part of the received signal sequence, and the first synthesized speech signal is provided from the synthesis filter.

When it is decided in step SP21 that no noise source code book index is contained in the received signal sequence, a second synthesized speech signal is created following the same procedure as that described previously with respect to the second noise source code book search step SP13 at the coding side in the first embodiment. The procedure starts with step SP23 in which a virtual synthesized speech signal obtainable from only an adaptive sound source vector corresponding to the received adaptive sound source code book index is input into the synthesis filter constructed using the LP parameter sent as part of the received signal sequence and a virtual reference speech signal is provided from the synthesis filter.

Next, in the second synthesized speech signal output step SP24, a noise source vector, which makes an optimum combination with the adaptive sound source vector corresponding to the received adaptive sound source code book index, is selected by the aforementioned A-b-S method, as a second noise source vector, so as to minimize the distortion of the second synthesized speech signal relative to the virtual reference speech signal created in step SP23, and the second synthesized speech signal is output. Upon outputting the synthesized speech signal of the current frame through execution of the above steps, the decoding procedure of the frame ends in step SP25 and decoding for the next frame begins with step SP20. This is repeated for each frame.

Figure 8:
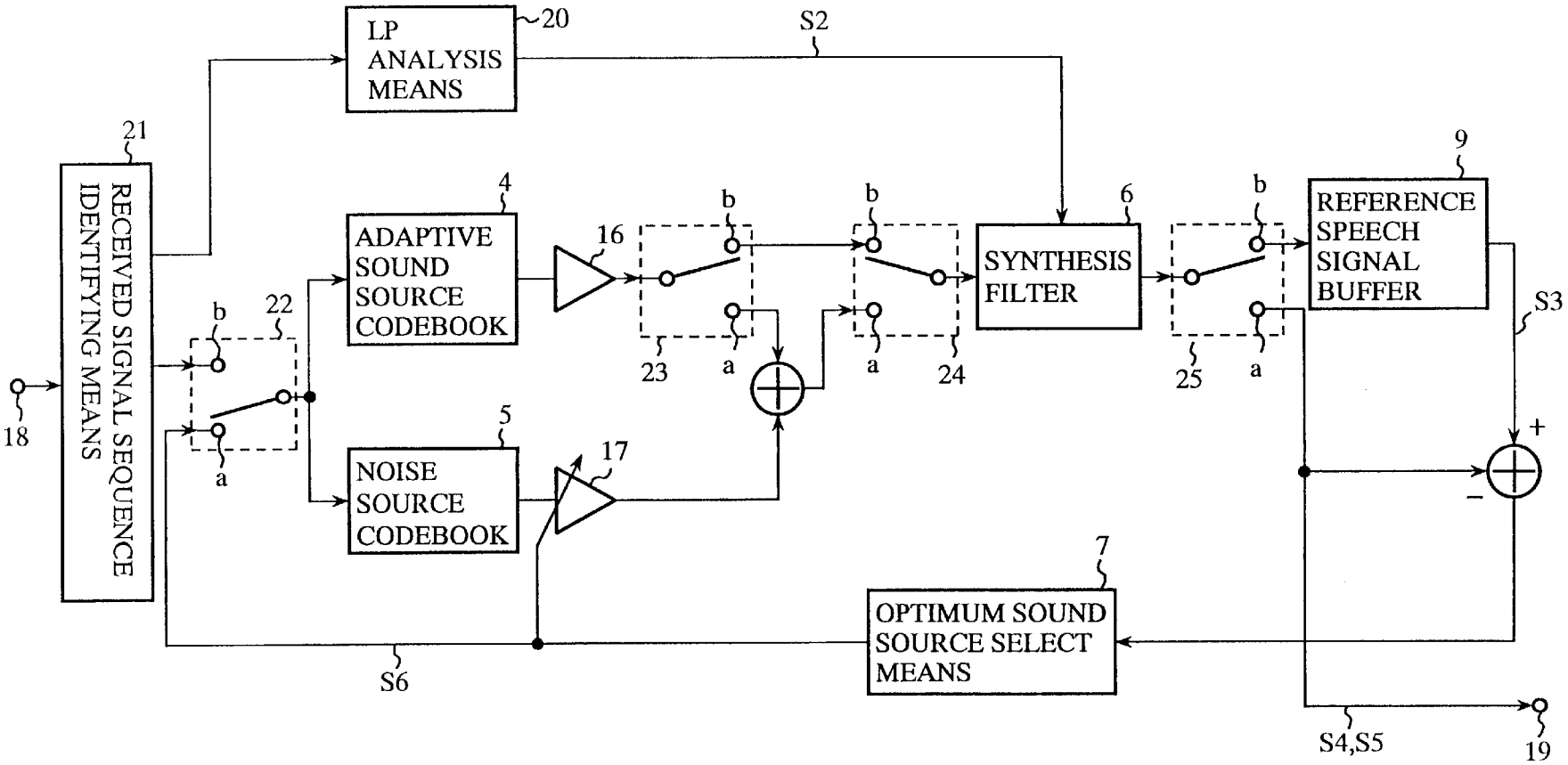
FIG. 8 is a block diagram for explaining the signal flow in the variable rate speech decoding method of FIG. 7.

Turning next to FIG. 8, concrete operations of the variable rate speech decoding method of this embodiment will be described. The parts corresponding to those in FIG. 2 are identified by the same reference numerals. Reference numeral 18 denotes a code input terminal, 19 a synthesized speech signal output terminal, 20 LP parameter decoding means, 21 received signal sequence identifying means, 22 an input select switch, 23 and 24 sound source select switches and 25 a synthesized speech signal select switch.

The received code is input from the code input terminal 18 and the synthesized speech signal is output from the synthesized speech signal output terminal 19. The LP parameter decoding means 20 decodes the LP parameter S2 from the received signal sequence. Based on the length of the received signal sequence, the received signal sequence identifying means 21 decides whether the noise code book index has been sent, and the means 21 outputs the received signal for each frame. The input select switch 22 responds to the result of decision by the received signal sequence identifying means 21 to switch the control signal input to the sound source code books. The sound source select switches 23 and 24 responds to the result of decision by the means 21 to switch the sound source signal that is input into the synthesis filter 6. The switch 25 controls the destination of the synthesized speech signal from the synthesis filter 6.

Next, a description will be given, with reference to FIGS. 7 and 8, of the operation of each step. Since the received signal sequence identifying step SP21 in FIG. 8 simply corresponds to the means 21 in FIG. 8, no description will be repeated thereof. In the first synthesized speech signal output step SP27, the input select switch 22 is connected to the terminal b, the sound source select switch 23 to the terminal a, the sound source select switch 24 to the terminal b and the synthesized speech signal select switch 25 to the terminal a. With the switches thus connected, the synthesis filter 6 is supplied with a sound source signal composed of the adaptive sound source and the noise source vectors respectively corresponding to the indexes contained in the received signal sequence, and the synthesized speech signal by the synthesis filter 6 is obtained as the first synthesized speech signal S4.

In the virtual reference speech signal synthesize step SP23 all the input select switches 22, 23, 24 and 25 are connected to their terminals b. In this state, the adaptive sound source vector corresponding to the index contained in the received signal sequence is applied as a sound source signal to the synthesis filter 6 and the synthesized speech signal is obtained therefrom as the virtual reference speech signal S3, which is fed to the virtual reference signal buffer 9.

In the second synthesized speech signal output step SP24 the switches 22, 23, 24 and 25 are all connected to their terminals a. In this instance, the synthesis filter 6 is supplied with the sound source signal produced by adding together the adaptive sound source vector corresponding to the adaptive code book index contained in the received signal sequence and noise source vectors that are sequentially output from the noise source code book. And the second noise source vector is selected so that the distortion of the synthesized speech signal from the synthesis filter 6 is minimized relative to the virtual reference speech signal stored in the buffer 9 and the resulting synthesized speech signal is provided as the second synthesized speech signal S5.

According to Embodiment 2, even while the noise source vector is not sent thereto, the decoding side is capable of computing and using the second noise source vector described previously with reference to the first embodiment—this provides for enhanced quality of the output synthesized speech signal.

[Embodiment 3]

While Embodiment 1 employs the SN ratio as the criterion of judgement of the signal quality in step SP15*a*, it is also possible to employ a numerical measure which permits measurement of a distortion or error between waveforms, such as a Cepstrum distance or the like.

Although Embodiment 1 uses only the SN ratio in the threshold value computing step SP15*b* and in the threshold value comparison step SP15*c*, it is a matter of course that plural measures such as mentioned above can be used in combination.

Embodiment 1 adopts a configuration that includes the decision as to whether to send the noise source code book index in the code word sending line select step SP15, but the same results as those in Embodiment 1 could also be obtained with a configuration wherein the output in sep SP15 is used as a flag indicating the possibility of suspension of transmission and a superior base band signal processing section ultimately decides whether to send the noise code book index.

Further, according to Embodiment 2, the length of the received signal sequence is used to determine if the noise code book index is contained therein in step SP21, but it is possible to utilize a construction wherein a superior base band signal processing section makes the check and required but fewest possible indexes are received together with a flag indicating the result of the check.

While the preferred embodiments of the present invention have been described, they should be construed as being merely illustrative of the invention not as limiting it and it is apparent that many modifications and variations may be effected without departing from the scope of the novel concepts of the present invention.

What is claimed is:

1. A variable rate speech coding method for CELP speech coding system including an adaptive sound source code book for storing an adaptive sound source vector repeating sound source signals of previous frames at intervals of a pitch period and a noise source code book for storing noise source vectors, said method comprising the steps of:

selecting and outputting said adaptive sound source vector and a first noise source vector from said adaptive sound source code book and said noise source code book so that a first synthesized speech signal with a minimum distortion relative to an input speech signal is obtained;

synthesizing a virtual reference speech signal by using a sound source signal generated from said adaptive sound source vector;

selecting a second noise source vector corresponding to said adaptive sound source vector so that a second synthesized speech signal with a minimum distortion relative to said virtual reference signal is obtained; and suspending sending of a noise source code book index corresponding to said first noise source vector according to quality of said second synthesized speech signal.

2. The method according to claim 1, wherein the step of suspending the sending of said noise source code book index comprises the steps of:

converting speech quality of each of said first and second synthesized speech signals and said virtual reference speech signal into a numerical representation relative to the input speech signal;

calculating a threshold value for comparison through utilization of said speech quality of said first synthesized speech signal and said computed virtual reference speech signal;

comparing said second synthesized speech signal with said threshold value; and deciding whether or not to send a noise source code book index corresponding to said first noise source vector according to a result of comparison.

3. A variable rate speech decoding method for CELP speech decoding system including an adaptive sound source code book for storing an adaptive sound source vector repeating sound source signals of previous frames at intervals of a pitch period and a noise source code book for storing noise source vectors, said method comprising the steps of:

generating a first synthesized speech signal from a sound source generated using both of an adaptive sound source vector and a noise source vector corresponding to an adaptive sound source code book index and a noise source code book index when they are contained in a received signal sequence;

synthesizing a virtual reference speech signal from a sound source generated using said adaptive sound source vector corresponding to said adaptive sound source code book index when said noise source code book index is not contained in said received signal sequence; and selecting a noise source vector corresponding to an adaptive sound source vector indicated by said received adaptive sound source code book index so that a synthesized speech signal with a minimum distortion relative to said virtual reference speech signal is obtained, and outputting a second synthesized speech signal produced based on a result of said selection.

* * * * *